US011224912B2

(12) United States Patent
Nohara et al.

(10) Patent No.: US 11,224,912 B2
(45) Date of Patent: Jan. 18, 2022

(54) CASTING DEVICE

(71) Applicant: HONDA MOTOR CO., LTD., Tokyo (JP)

(72) Inventors: Yohei Nohara, Tochigi-ken (JP); Kenyu Usuzaki, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/213,279

(22) Filed: Mar. 26, 2021

(65) Prior Publication Data

US 2021/0299745 A1 Sep. 30, 2021

(30) Foreign Application Priority Data

Mar. 30, 2020 (JP) ..... JP2020-059358

(51) Int. Cl.

| | |
|---|---|
| ***B22D 17/14*** | (2006.01) |
| ***B22D 25/02*** | (2006.01) |
| ***B22D 33/04*** | (2006.01) |
| ***B22C 9/06*** | (2006.01) |
| ***B22C 9/10*** | (2006.01) |
| ***B22C 9/24*** | (2006.01) |

(52) U.S. Cl.

CPC ..... *B22D 17/14* (2013.01); *B22C 9/067* (2013.01); *B22C 9/24* (2013.01); *B22D 25/02* (2013.01)

(58) Field of Classification Search

CPC .. B22C 9/06; B22C 9/062; B22C 9/10; B22C 9/108; B22C 9/24; B22D 17/14; B22D 25/02; B22D 33/04

USPC ..... 164/253, 254, 256, 339, 340, 341, 342, 164/137

See application file for complete search history.

(56) References Cited

U.S. PATENT DOCUMENTS

| | | | | |
|---|---|---|---|---|
| 4,738,298 | A * | 4/1988 | Taruno et al. ..... | B22D 19/0009 164/103 |
| 4,766,944 | A * | 8/1988 | Sakuma et al. ..... | B22D 17/145 164/305 |
| 2015/0027654 | A1* | 1/2015 | Nishikawa ..... | B22C 9/24 164/112 |

FOREIGN PATENT DOCUMENTS

| | | |
|---|---|---|
| JP | 08-132210 | 5/1996 |
| JP | 2510455 | 9/1996 |

* cited by examiner

*Primary Examiner* — Kevin P Kerns

(74) *Attorney, Agent, or Firm* — Amin, Turocy & Watson, LLP

(57) ABSTRACT

A casting device includes a bore formation core and a water jacket formation core. When a cavity is formed, gas existing in a space between both cores is suctioned through a flow path formed in the bore formation core under operation of a suctioning device. When the bore formation core is viewed from a side, this flow path exists above a virtual axial line that passes a center of the bore formation core and extends along a longitudinal direction of the bore formation core.

9 Claims, 5 Drawing Sheets

CASTING DEVICE

CROSS-REFERENCE TO RELATED APPLICATION

This application is based upon and claims the benefit of priority from Japanese Patent Application No. 2020-059358 filed on Mar. 30, 2020, the contents of which are incorporated herein by reference.

BACKGROUND OF THE INVENTION

Field of the Invention

The present invention relates to a casting device for obtaining a cylinder block.

Description of the Related Art

In one of the conventionally known internal-combustion engines for automobiles, a plurality of cylinder bores are formed in a cylinder block and the adjacent cylinder blocks form a V shape, which is a so-called V type. Usually, a water jacket that serves as a path for cooling water is formed around the cylinder bores. The cylinder block including such cylinder bores and water jacket can be obtained by casting with the use of a casting device as disclosed in Japanese Utility Model Registration No. 2510455, for example.

In this case, the casting device includes a fixed die that is positioned and fixed, a movable die that approaches or separates from the fixed die, a bore formation core that is used to form a cylinder bore, and a water jacket formation core that is used to form a water jacket. With the fixed die and the movable die, a cavity is formed. In addition, the bore formation core and the water jacket formation core are provided to a movable platen that supports the movable die.

As described in Japanese Laid-Open Patent Publication No. 08-132210, a water jacket formation core is provided to surround an outer peripheral side of a bore formation core. Here, at a movable platen, an actuator that integrally displaces the bore formation core and the water jacket formation core is supported. The actuator is disposed at a position farther from a cavity than the bore formation core and the water jacket formation core, and makes both cores advance toward or retract from the cavity. In other words, the bore formation core and the water jacket formation core approach or separate from the cavity integrally under the operation of the actuator.

In the casting, before the dies are closed, a release material is applied (for example, spray application) to the fixed die, the movable die, the bore formation core, and the water jacket formation core. It is assumed that the release material scattering in the air at this time enters the casting device through a space between the movable platen and the actuator, and moreover goes around to the bore formation core side. When the release material has entered the cavity from the bore formation core, the amount of release material in the cavity becomes excessive.

In order to avoid this, in the technique according to Japanese Utility Model Registration No. 2510455, a flow path for compressed air is formed in a bore formation core ("bore pin" in Japanese Utility Model Registration No. 2510455) and a release material is blown off using air blow with dies opened. Thus, the entry of the release material into a cavity through the bore formation core is prevented. Instead of using the air blow, an O-ring may be provided at a portion of the bore formation core that is not embedded in a molten metal filling the cavity. With the O-ring, the space between the bore formation core and a water jacket formation core can be sealed.

SUMMARY OF THE INVENTION

In the middle of filling the cavity with the molten metal, most part of the gas in the cavity is discharged into the air from a vent hole formed in the casting device. However, it is not easy for the gas in the space between the bore formation core and the water jacket formation core to go around to enter the vent hole. Therefore, the gas is entrapped near an opening of a cylinder bore on a gasket surface, for example. If the gas is entrapped too much, a casting defect such as a blow hole is easily formed and in this case, the quality of a cylinder block deteriorates.

A main object of the present invention is to provide a casting device that can obtain a cylinder block with high quality while preventing gas from being entrapped in a molten metal.

According to one embodiment of the present invention, a casting device includes a fixed die and a movable die that approaches or separates from the fixed die, and forms a cavity to obtain a cylinder block with the fixed die and the movable die, the casting device including: a bore formation core configured to form a cylinder bore in the cylinder block; a water jacket formation core surrounding the bore formation core from an outer peripheral side and configured to form a water jacket around the cylinder bore; an actuator configured to displace the bore formation core and the water jacket formation core integrally in a direction of getting close to or being separated from the cavity; a seal member disposed in a space between the bore formation core and the water jacket formation core, and configured to section the space into a close side part that is close to the cavity and a separation side part that is apart from the cavity; and a suctioning device configured to suction gas in the close side part through a flow path formed in the bore formation core, wherein the bore formation core includes a near part that faces the close side part and is always exposed from molten metal in the cavity, a far part that faces the separation side part, and a bore formation part that protrudes from the near part toward the cavity and is embedded in the molten metal in the cavity; and the flow path includes a first opening formed on an outer surface of the near part and a second opening formed on an outer surface of the far part and connected to the suctioning device, and the flow path exists above a virtual axial line that passes a center of the bore formation core and extends along a longitudinal direction of the bore formation core when the bore formation core is viewed from a side.

According to the present invention, when the cavity is filled with the molten metal, the gas existing in the space between the bore formation core and the water jacket formation core can be removed from the space by the flow path formed at a predetermined part of the bore formation core. Thus, it is possible to prevent the gas from being entrapped in the molten metal, and therefore a casting defect is hardly formed in the cylinder block, which is a cast product. That is to say, the quality of the cylinder block is improved.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

A preferred embodiment of a casting device according to the present invention is hereinafter described in detail with reference to the attached drawings. Note that "front (forward)" in the following description indicates the side closer to a cavity 22 in FIG. 2. In addition, "rear" indicates a direction opposite to "front (forward)", that is, the side away from the cavity 22.

Figure 1:
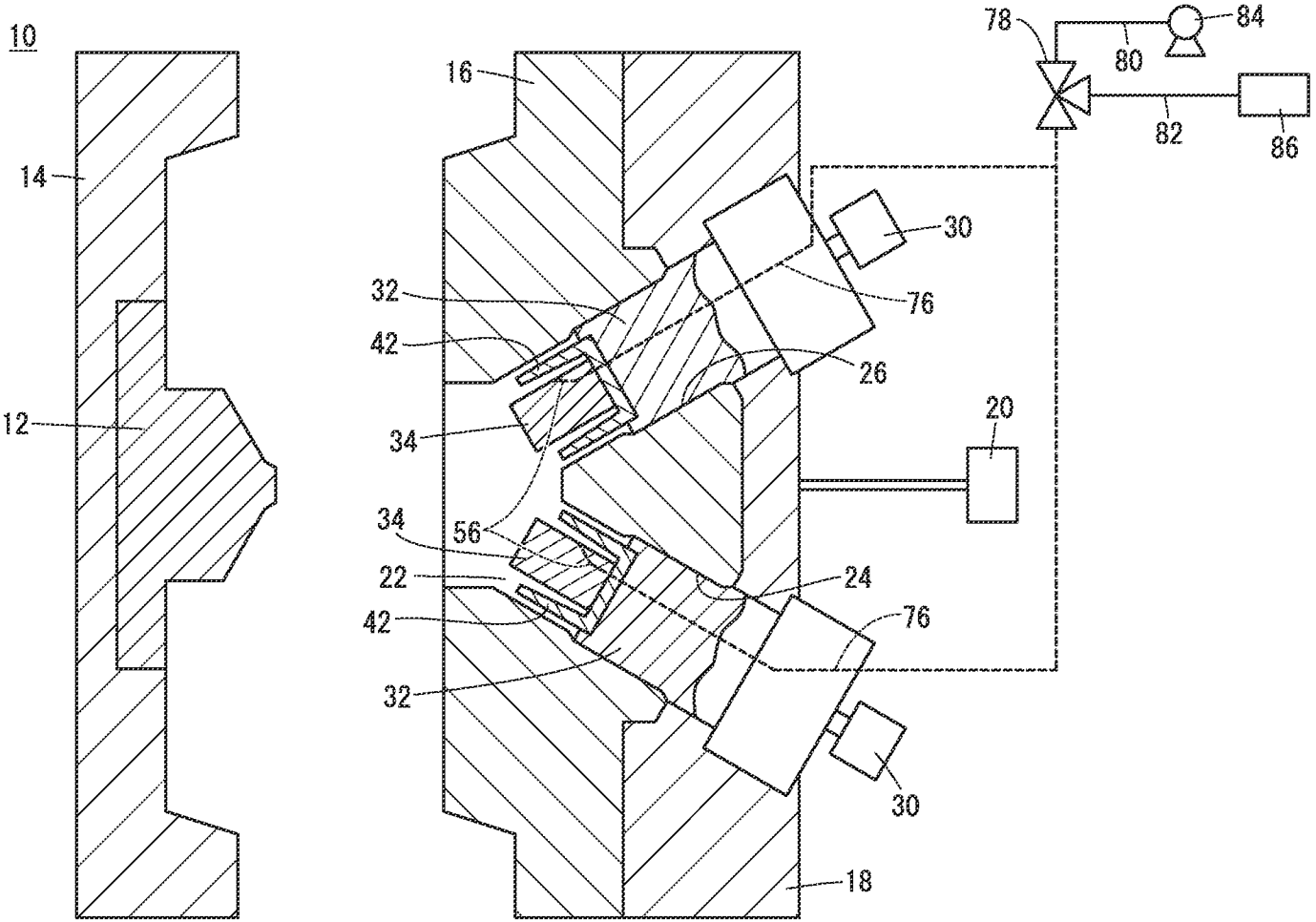
FIG. 1 is a schematic longitudinal cross-sectional view of a casting device according to one embodiment of the present invention when dies are open.
Figure 2:
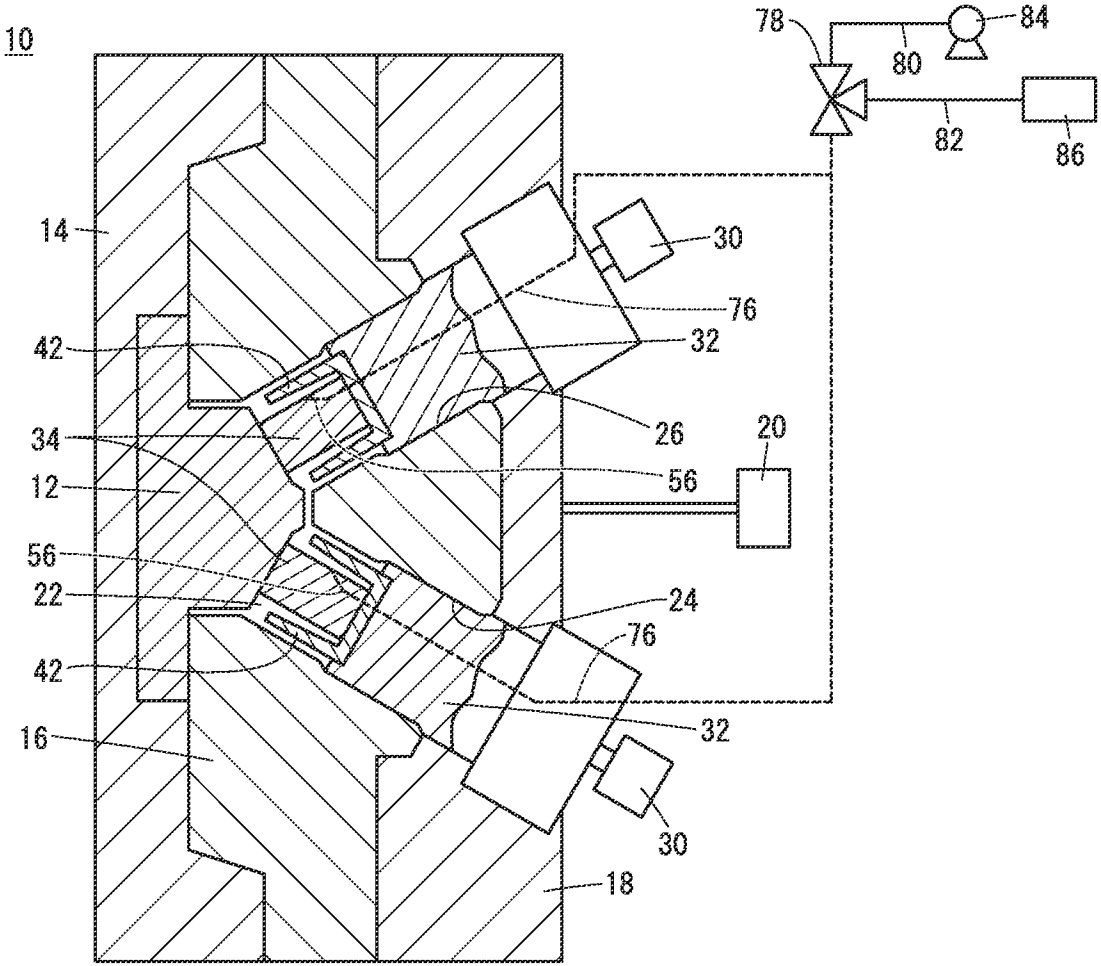
FIG. 2 is a schematic longitudinal cross-sectional view of the casting device when the dies are closed.

FIG. 1 and FIG. 2 are schematic longitudinal cross-sectional views of a main part when dies of a casting device 10 according to the present embodiment are opened and closed, respectively. This casting device 10 includes a fixed platen 14 where a fixed die 12 is provided, and a movable platen 18 where a movable die 16 is provided. The movable platen 18 can approach or separate from the fixed platen 14 under the operation of an open/close cylinder 20. As the movable platen 18 approaches or separates from the fixed platen 14, the movable die 16 approaches or separates from the fixed die 12.

With the fixed die 12 and the movable die 16 that are in the closed state, the cavity 22 illustrated in FIG. 2 is formed. In the present embodiment, the cavity 22 is to form a cylinder block of a six-cylinder V-type internal combustion engine. Note that at least one of the movable platen 18 and the fixed platen 14 includes a vent hole (not illustrated) used to exhaust gas in the cavity 22 into the air when the cavity 22 is filled with molten metal. To the fixed platen 14, an ejector pin that is not illustrated is provided in a manner that the ejector pin can be exposed to the cavity 22 or can retract from the cavity 22.

In the movable platen 18, first sliding grooves 24 and second sliding grooves 26 each having a shape extending radially from the movable die 16 are formed. The first sliding groove 24 and the second sliding groove 26 are formed to have a shape like a letter of V in a recumbent state. Three first sliding grooves 24 and three second sliding grooves 26 are formed in parallel along a direction perpendicular to the paper surface of FIG. 1 and FIG. 2. Note that in FIG. 1 and FIG. 2, one of the three first sliding grooves 24 and one of the three second sliding grooves 26 are illustrated.

Figure 3:
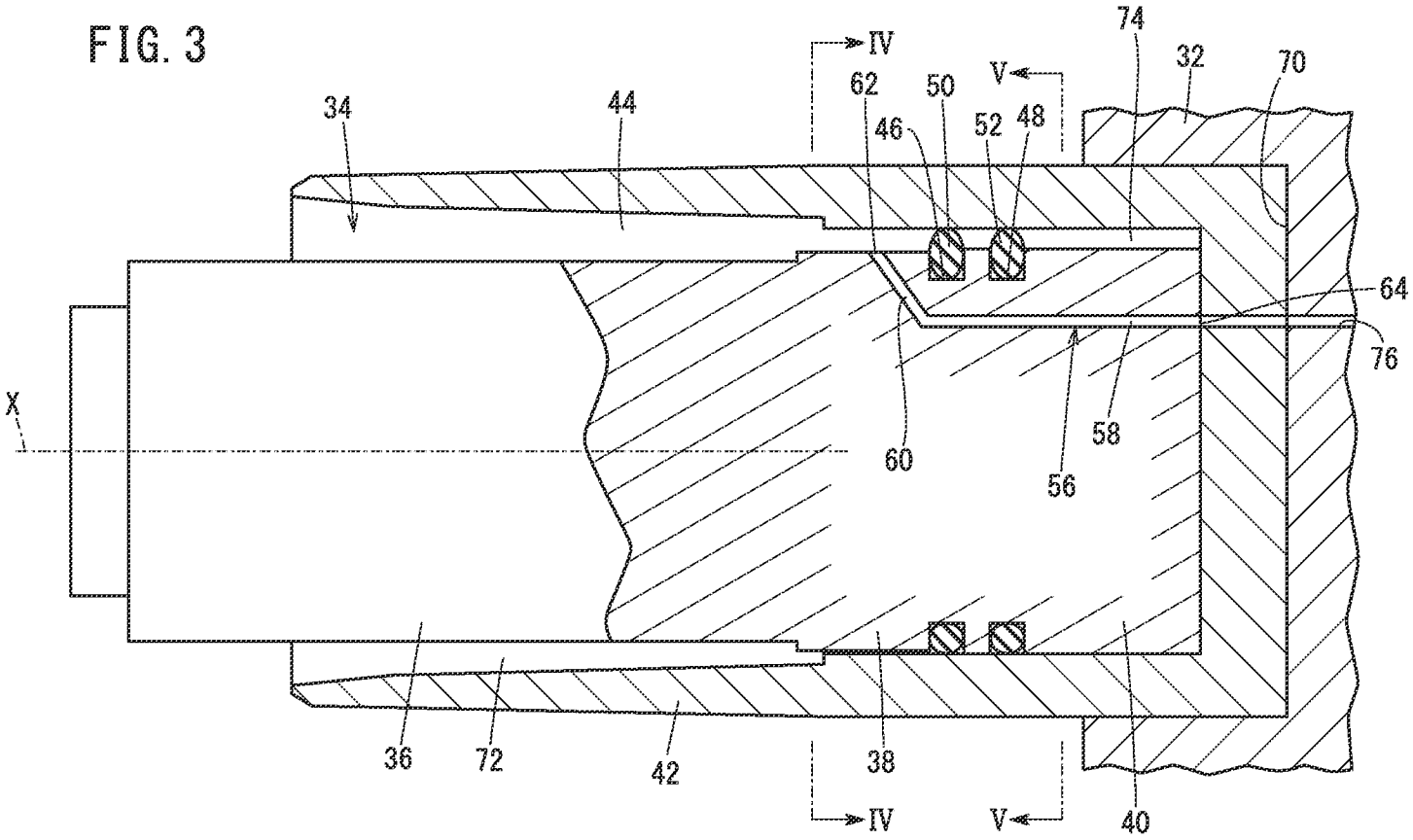
FIG. 3 is a schematic side cross-sectional view taken along a longitudinal direction of a bore formation core and a water jacket formation core in the casting device.

In the first sliding groove 24, a bore pin displacement cylinder 30 (actuator) is housed. A rod of the bore pin displacement cylinder 30 is connected to a core holder 32 that slides along the first sliding groove 24. As illustrated in FIG. 3, a bore pin 34 is provided as a bore formation core at a front end of the core holder 32 that faces the cavity 22. The bore pin 34 includes a bore formation part 36, a near part 38, and a far part 40 in this order from a front end side, which is close to the cavity 22, to a rear end side. In this case, the diameters of the bore formation part 36, the near part 38, and the far part 40 are different from each other. Specifically, the diameter of the bore formation part 36 is small, the diameter of the far part 40 is large, and the diameter of the near part 38 is a little smaller than that of the far part 40.

The bore formation part 36 protruding from the near part 38 to the cavity 22 is a part that is embedded in the molten metal when the cavity 22 is filled with the molten metal. When the bore formation part 36 is extracted from the molten metal whose fluidity has been lost to some extent, the cylinder bore is formed. On the other hand, the near part 38 and the far part 40 are always exposed from the molten metal in the cavity 22. That is to say, the near part 38 and the far part 40 are not involved in the formation of the cylinder bore.

The inner diameter of a water jacket formation core 42 is large at a portion facing the bore formation part 36 and the near part 38, and small at a portion facing the far part 40. Each side peripheral wall (side wall) of the bore formation part 36 and the near part 38 is apart from an inner peripheral wall (inner wall) of the water jacket formation core 42 along the entire circumference. Therefore, a space 44 is formed between the bore formation part 36 and the near part 38 of the bore pin 34, and the water jacket formation core 42. The water jacket formation core may also be referred to as "WJ core" below.

Figure 4:
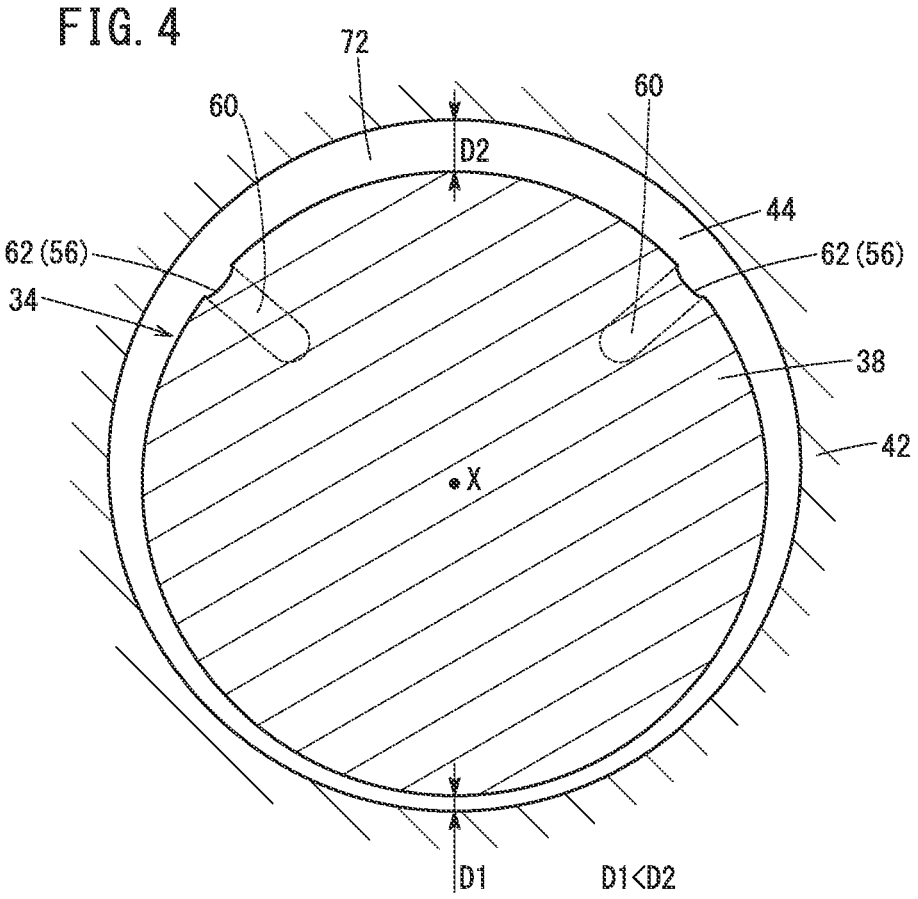
FIG. 4 is a cross-sectional view taken along an arrow IV-IV in FIG. 3.
Figure 5:
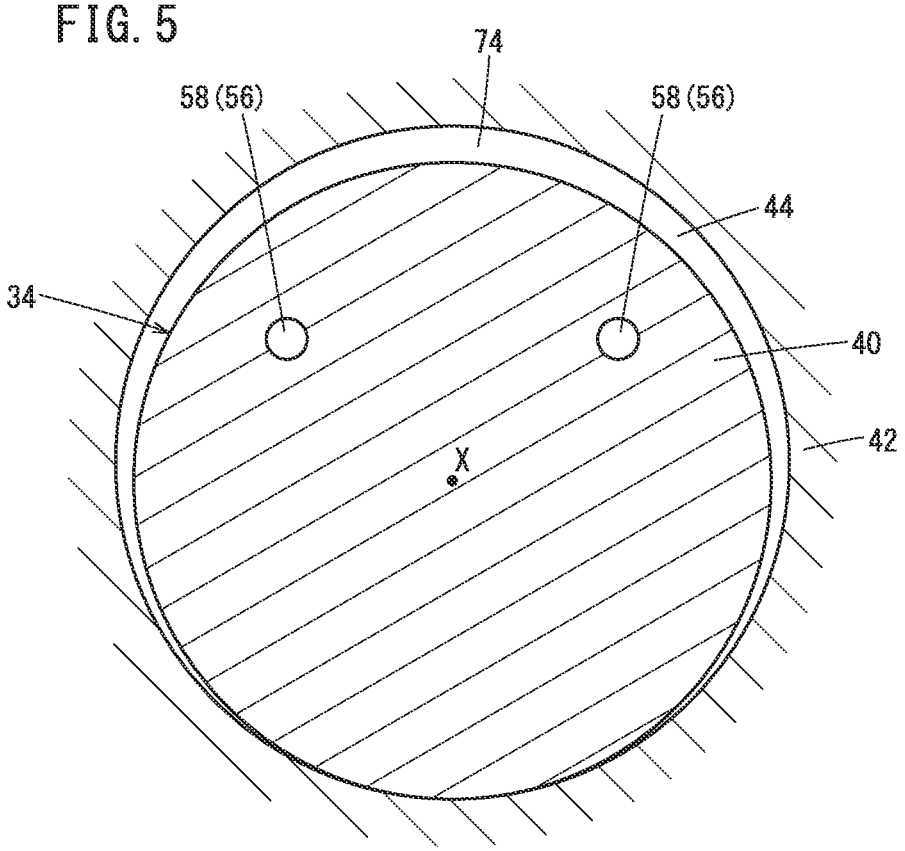
FIG. 5 is a cross-sectional view taken along an arrow V-V in FIG. 3.

As illustrated in FIG. 3 and FIG. 5, a lower part of a side peripheral wall (lower part of side wall) of the far part 40, where the diameter is the maximum, is in contact with a lower part of the inner peripheral wall (lower part of inner wall) of the WJ core 42. By this contact, the bore pin 34 is supported by the WJ core 42 and thus, the bore pin 34 is positioned. On the other hand, an upper part of the side peripheral wall (upper part of side wall) of the far part 40 is apart from an upper part of the inner peripheral wall (upper part of inner wall) of the WJ core 42 as illustrated in FIG. 4. That is to say, a lower part of the space 44 is a little closed by a lower part of the far part 40, and a side part and an upper part of the space 44 are narrowed by a side part and an upper part of the far part 40.

On the side peripheral wall of the far part 40, a first annular groove 46 and a second annular groove 48 are formed along a circumferential direction. To these first annular groove 46 and second annular groove 48, a first O-ring 50 and a second O-ring 52 are fitted as sealing members. The first O-ring 50 and the second O-ring 52 seal between the side peripheral wall of the far part 40 of the bore pin 34, and the inner peripheral wall of the WJ core 42.

Inside the bore pin 34, a plurality of (for example, two) flow paths 56 are formed. Each flow path 56 includes an inner hole 58 linearly extending toward the near part 38 from a rear end surface of the far part 40 of the bore pin 34 that faces the core holder 32, and an inclined path 60 that is inclined toward an upper part of the side peripheral wall of the near part 38 (see FIG. 3 in particular). The inclined path 60 is inclined from the far part 40 (rear end) to the near part 38 (front end), and opens at the side peripheral wall of the near part 38. In this manner, the flow path 56 includes a first opening 62 (particularly, see FIG. 4) present at the side peripheral wall of the near part 38, and a second opening 64 (see FIG. 3) present at the rear end surface of the far part 40. Note that the first opening 62 is formed at a portion that is near the first O-ring 50 and on the front side closer to the bore formation part 36 than the first O-ring 50.

FIG. 3 illustrates a virtual axial line X that splits the bore pin 34 into two in a height direction. When the bore pin 34 is viewed from the side, this virtual axial line X extends along a longitudinal direction of the bore pin 34, passing the center of the bore pin 34. The flow path 56 including the first opening 62 and the second opening 64 exists entirely above the virtual axial line X.

A rear end of the WJ core 42 is fitted to a fitting concave part 70 formed at a front end of the core holder 32. By this fitting and a connection of the WJ core 42 to the core holder 32 through a bolt or the like as necessary, the WJ core 42 is supported by the core holder 32. In this manner, both the bore pin 34 and the WJ core 42 are supported by the core holder 32. Therefore, as the rod of the bore pin displacement cylinder 30 advances or retracts, the bore pin 34 and the WJ core 42 are displaced integrally with the core holder 32.

The WJ core 42 has an approximately cylindrical shape, and surrounds the bore pin 34 from the outer peripheral side. The WJ core 42 is shorter than the bore pin 34 and a part of the bore formation part 36 of the bore pin 34 is exposed from the front end of the WJ core 42. As described above, the space 44 is formed between the inner peripheral wall of the WJ core 42 and the side peripheral wall of the bore pin 34. This space 44 is sectioned by the first O-ring 50 and the second O-ring 52 into a close side part 72 that is close to the cavity 22 and a separation side part 74 that is apart from the cavity 22.

Since the first O-ring 50 and the second O-ring 52 are provided to the far part 40 of the bore pin 34, the close side part 72 of the space 44 faces the near part 38 and the bore formation part 36 while the separation side part 74 faces the far part 40. In addition, since the first opening 62 of the flow path 56 is formed in the near part 38 and the second opening 64 of the flow path 56 is formed in the far part 40, the flow path 56 extends from the close side part 72 to the separation side part 74.

Back to FIG. 1 and FIG. 2, a structure similar to that in the first sliding groove 24 is also provided in the second sliding groove 26. Therefore, the same component as that described above is denoted by the same reference sign and the detailed description thereof is omitted.

In the present embodiment, the bore pins 34 adjacent to each other (or facing each other) in an up-down direction are inclined to form a V shape in the recumbent state. That is to say, the lower bore pin 34 is inclined so that the front end is at a higher position than the rear end, and the upper bore pin 34 is inclined so that the rear end is at a higher position than the front end. Note that three upper bore pins 34 and three lower bore pins 34 are arranged in parallel along the direction perpendicular to the paper surface of FIG. 1 and FIG. 2.

Due to the influence from the gravity, the lower and upper bore pins 34 are all inclined so that the front end side is directed upward and the rear end side is directed downward with respect to the extending direction of the first annular groove 46 and the second annular groove 48. Therefore, as described above, the lower part of the side peripheral wall of the far part 40 of the bore pin 34 is in contact with the lower part of the inner peripheral wall of the WJ core 42. In addition, between the side peripheral wall of the near part 38 of the bore pin 34 and the inner peripheral wall of the WJ core 42, the space 44 becomes small on the lower side and large on the upper side as illustrated in FIG. 4. That is to say, a separation distance D1 on the lower side is smaller than a separation distance D2 on the upper side.

The separation distance D2 between the upper part of the side peripheral wall of the near part 38 and the upper part of the inner peripheral wall of the close side part 72 of the WJ core 42 is set to 50 μm or less. Note that since the bore pin 34 is positioned by bringing the lower part of the side peripheral wall of the far part 40 and the lower part of the inner peripheral wall of the WJ core 42 in contact with each other, the separation distance D2 can be set to 50 μm or less with high accuracy. Thus, the upper part of the side peripheral wall of the near part 38 of the bore pin 34 and the upper part of the inner peripheral wall of the close side part 72 of the WJ core 42 can be separated from each other sufficiently.

Each flow path 56 of the bore pin 34 is connected to a front end of a flow pipe 76 through the second opening 64. Rear ends of the flow pipes 76 are converged to a switch valve 78. By this switch valve 78, all the flow pipes 76 communicate with any of an exhaust pipe 80 or a supply pipe 82 selectively at the same time. Here, the exhaust pipe 80 is connected to a suction pump 84 as a suctioning device. In addition, the supply pipe 82 is connected to a compressor 86 (fluid supply device) that supplies compressed air as a blowing fluid. Therefore, under the operation of the suction pump 84, the gas in the space 44 can be suctioned, and the compressed air can be supplied to the space 44 under the operation of the compressor 86.

The casting device 10 according to the present embodiment is basically configured as described above, and the operation effect thereof is described from the viewpoint of the operation of the casting device 10. The following operation is basically performed in accordance with sequence control operation of a control device that is not illustrated.

Before the casting work, a release material is applied to the fixed die 12, the movable die 16, the bore pin 34, the WJ core 42, and the like while the dies are open as illustrated in FIG. 1. This application is performed by, for example, applying the release material from an application gun provided at an end arm of a robot (not illustrated), that is, by spray application. The release material partially scatters in a mist form in the air, and then adheres to the casting device 10.

Then, the dies are closed to perform the casting work. That is to say, the bore pin displacement cylinder 30 is energized and accordingly, the bore pin 34 and the WJ core 42 are displaced in a direction of approaching the movable die 16 integrally with the core holder 32. The suction pump 84 may be energized at the time when the bore pin displacement cylinder 30 is energized. Here, the flow path 56 communicates with the exhaust pipe 80 through the flow pipe 76 and the switch valve 78.

Next, the open/close cylinder 20 is energized so that movable platen 18 approaches the fixed platen 14. As a result, the movable die 16 and the fixed die 12 are closed to form the cavity 22 as illustrated in FIG. 2. Here, a part of the release material that has adhered to the casting device 10 may enter the movable platen 18 along the core holder 32 and the bore pin 34, and go to the cavity 22. In this case, however, the second O-ring 52 stops the release material. Thus, the release material is prevented from going forward over the far part 40 of the bore pin 34. As a result, it is possible to prevent the amount of release material in the cavity 22 from becoming excessive.

After the cavity 22 is formed, the molten metal is poured into the cavity 22. While the molten metal is poured, most part of the gas in the cavity 22 is discharged into the air outside the cavity 22 through the vent hole.

In addition, the gas existing in the space 44 between the near part 38 and the bore formation part 36 of the bore pin 34, and the WJ core 42 is suctioned into the inclined path 60 through the first opening 62 of the flow path 56 under the operation of the suction pump 84. Here, as described above, the separation distance D2 between the upper part of the side peripheral wall of the bore pin 34 and the upper part of the inner peripheral wall of the WJ core 42 is larger than the separation distance D1 between the lower part of the side peripheral wall of the bore pin 34 and the lower part of the inner peripheral wall of the WJ core 42. The flow path 56 is formed above the virtual axial line X of the bore pin 34, and thus deviated to the upper side of the bore pin 34. Therefore, near the first opening 62, the upper part of the side peripheral wall of the near part 38 of the bore pin 34 and the upper part of the inner peripheral wall of the close side part 72 of the WJ core 42, are sufficiently apart from each other. Accordingly, the gas existing in the space 44 is suctioned easily.

The gas flows in the flow pipe 76 and the exhaust pipe 80 through the inclined path 60 and the second opening 64 of the inner hole 58, and is discharged into the atmospheric air through the suction pump 84. In the present embodiment, the first opening 62 of the flow path 56 is formed near a first seal member. Therefore, the gas existing in the space 44 flows smoothly in a direction of separating from the cavity 22 and accordingly, the occurrence of vortex of the gas in the space 44 can be suppressed. As a result, the gas can be removed efficiently from the space 44.

Furthermore, in the present embodiment, the separation distance D2 between the upper part of the side peripheral wall of the near part 38 of the bore pin 34 and the upper part of the inner peripheral wall on the close side of the WJ core 42 is set to 50 μm or less. In addition, the separation distance D1 between the lower part of the side peripheral wall of the near part 38 of the bore pin 34 and the lower part of the inner peripheral wall on the close side of the WJ core 42 is smaller than the separation distance D2. Thus, it becomes difficult for powder burr to enter the space 44. That is to say, the space 44 or the first opening 62 is hardly blocked with the powder burr. Therefore, the gas existing in the space 44 can be suctioned continuously.

For these reasons, it is possible to prevent a large amount of gas from being entrapped in a part of the molten metal that becomes the gasket surface or a part to become the cylinder bore, for example. Accordingly, the occurrence of a casting defect such as a blow hole in the cylinder block can be suppressed and the cylinder block with excellent quality can be obtained.

After a predetermined time from the end of the pouring of the molten metal, for example, when the molten metal has solidified to such a degree that the fluidity is lost, the open/close cylinder 20 is energized. That is to say, the movable platen 18 and the movable die 16 are displaced to be separated from the fixed platen 14 and the fixed die 12, and thus the dies are opened. As a result, the casting device 10 returns to the state illustrated in FIG. 1, and the cylinder block is exposed. The cylinder block adheres to the fixed die 12.

At substantially the same time as when the open/close cylinder 20 is energized, the switch valve 78 is operated to block the communication (connection) between the flow pipe 76 and the exhaust pipe 80, and the flow pipe 76 and the supply pipe 82 communicate (connect) with each other. Note that the compressor 86 is energized before this switching. For example, the compressor 86 may be energized when the dies start to be closed.

Therefore, the compressed air from the compressor 86 flows to the second opening 64 of the flow path 56 (inner hole 58) through the supply pipe 82 and the flow pipe 76. Moreover, the compressed air is discharged from the first opening 62 of the inclined path 60 toward the space 44. That is to say, air blow is started. Even if the powder burr has entered the space 44, this air blow makes the powder burr go out of the space 44. At this time, the bore pin 34 is not yet released from the cylinder block; therefore, the compressed air is in contact with the cylinder block. Therefore, the cylinder block is cooled efficiently.

Next, as the bore pin displacement cylinder 30 is energized, the bore pin 34 and the WJ core 42 are displaced integrally with the core holder 32 in a direction of separating from the movable die 16. In addition, the ejector pin provided to the fixed platen 14 is displaced so as to be exposed from the cavity 22, and pushes the cylinder block out of the fixed die 12. Thus, the cylinder block is released from the die. Therefore, the compressed air discharged from the first opening 62 is in contact with not just the bore pin 34 and the WJ core 42 but also the movable die 16 and the fixed die 12. Accordingly, the movable die 16 and the fixed die 12 can be cooled efficiently.

In a case where the release material, a casting piece, or the like remains in the bore pin 34, the WJ core 42, the movable die 16, and the fixed die 12, such residue is blown by the compressed air. That is to say, by the compressed air, the casting device 10 is cleaned. Therefore, the additional cleaning is not necessary. As a result, the cycle time from the start of the application of the release material to the end of the cleaning can be shortened.

Here, the inclined path 60 is inclined from the far part 40 (rear end) to the near part 38 (front end). Therefore, the powder burr, the release material, the casting piece, or the like is pressed by the compressed air so as to go forward over the first opening 62. Therefore, the first opening 62 will not be blocked with the powder burr, the release material, the casting piece, or the like. Accordingly, the air blow can be continued for a long time.

The present invention is not limited to the aforementioned embodiment in particular, and various changes are possible in the range not departing from the concept of the present invention.

For example, in the casting device 10, the bore pins 34 that are adjacent to each other (face each other) may rise to form a V shape. Alternatively, in the casting device 10, the cylinder bores may be arranged in a straight line and a so-called inline internal combustion engine may be obtained.

Further alternatively, in addition to the flow path 56 formed above the virtual axial line X, another flow path may be formed below the virtual axial line X.

Although not illustrated in particular, a cylinder sleeve may be externally fitted to the bore pin 34.

Although the first O-ring 50 and the second O-ring 52 are used as the seal member in this embodiment, the number of seal members may be one, or three or more. In the case of the three or more seal members, the first opening 62 may be provided ahead of the foremost seal member. In this case, the space 44 is sectioned into the close side part 72, which is ahead of the foremost seal member, and the separation side part 74 behind the rearmost seal member.

What is claimed is:

1. A casting device including a fixed die and a movable die that approaches or separates from the fixed die and forming a cavity to obtain a cylinder block with the fixed die and the movable die, the casting device comprising:

a bore formation core configured to form a cylinder bore in the cylinder block;

a water jacket formation core surrounding the bore formation core from an outer peripheral side and configured to form a water jacket around the cylinder bore;

an actuator configured to displace the bore formation core and the water jacket formation core integrally in a direction of getting close to or being separated from the cavity;

a seal member disposed in a space between the bore formation core and the water jacket formation core, and configured to section the space into a close side part that is close to the cavity and a separation side part that is apart from the cavity; and a suctioning device configured to suction gas in the close side part through a flow path formed in the bore formation core, wherein the bore formation core includes a near part that faces the close side part and is always exposed from molten metal in the cavity, a far part that faces the separation side part, and a bore formation part that protrudes from the near part toward the cavity and is embedded in the molten metal in the cavity; and the flow path includes a first opening formed on an outer surface of the near part and a second opening formed on an outer surface of the far part and connected to the suctioning device, and the flow path exists above a virtual axial line that passes a center of the bore formation core and extends along a longitudinal direction of the bore formation core when the bore formation core is viewed from a side.

2. The casting device according to claim 1, wherein the first opening is formed near the seal member.

3. The casting device according to claim 1, further comprising a fluid supply device configured to supply a blow fluid from the separation side part to the close side part through the flow path.

4. The casting device according to claim 1, wherein the first opening is formed on a side wall of the near part, the flow path includes an inclined path from inside of the bore formation core to the first opening, and the inclined path is inclined in a direction from the far part to the near part.

5. The casting device according to claim 1, comprising a plurality of the bore formation cores and the water jacket formation cores, wherein the adjacent bore formation cores form a V shape.

6. The casting device according to claim 5, wherein the adjacent bore formation cores are arranged in an up-down direction.

7. The casting device according to claim 6, wherein the far part of the bore formation core has larger diameter than the near part, a lower part of the far part is in contact with an inner wall of the water jacket formation core, an upper part of the far part is apart from the inner wall of the water jacket formation core, and a side wall of the near part is apart from the inner wall of the water jacket formation core along an entire circumference.

8. The casting device according to claim 7, wherein a separation distance between a lower part of the near part and the inner wall of the water jacket formation core is smaller than a separation distance between an upper part of the near part and the inner wall of the water jacket formation core.

9. The casting device according to claim 8, wherein the separation distance between the upper part of the near part and the inner wall of the water jacket formation core is 50 μm or less.

* * * * *